United States Patent [19]

Hetherington et al.

[11] Patent Number: 4,770,117

[45] Date of Patent: Sep. 13, 1988

[54] FIBERGLASS REINFORCE PRODUCT SPRAY GUN WITH ROVING CUTTER STEERING MECHANISM

[75] Inventors: Robert D. Hetherington; James E. Cavanaugh, both of Sunland, Calif.

[73] Assignee: Binks Manufacturing Company, Franklin Park, Ill.

[21] Appl. No.: 21,818

[22] Filed: Mar. 4, 1987

[51] Int. Cl.[4] ..... B05B 7/14; B05B 7/08

[52] U.S. Cl. ..... 118/300; 427/196; 427/426; 239/420; 239/422; 239/433; 239/DIG. 8

[58] Field of Search ..... 239/420, DIG. 8, 433, 239/422; 118/300; 427/196, 426

[56] References Cited

U.S. PATENT DOCUMENTS

| | | | |
|---|---|---|---|
| 3,155,320 | 11/1964 | Jones | 239/420 |
| 3,399,834 | 9/1968 | Bradley | 239/DIG. 8 |
| 3,504,861 | 4/1970 | Peeps et al. | 239/DIG. 8 |
| 3,542,296 | 11/1970 | Bradley | 239/DIG. 8 X |
| 3,801,009 | 4/1974 | Marshall | 239/433 X |
| 3,927,833 | 12/1975 | Harrison et al. | 239/DIG. 8 X |
| 3,967,004 | 6/1976 | Oda | 427/426 X |
| 4,042,175 | 8/1975 | Johnson | 239/420 |

*Primary Examiner*—Shrive P. Beck
*Attorney, Agent, or Firm*—David O'Reilly

[57] ABSTRACT

A roving cutting steering mechanism for use with a plural component spray gun for producing fiberglass reinforced products. A roving cutter is mounted on a plural component spray gun with a support plate and a bracket which is easily vertically adjustable by loosening a bolt mounting the bracket on the gun body. Horizontal adjustment is provided by a cam fitting a slot in the end of a bracket which shifts a mounting plate horizontally. The roving cutter being mounted on the plate is steered to align the path of cuttings ejected from the roving cutter to the optimum position for intersecting the fluid path of material being sprayed by the spray gun. Quick easy adjustment both vertically and horizontally of a roving cutter allows optimizing the mixture of roving cuttings with a spray of plural components being applied to a surface.

3 Claims, 3 Drawing Sheets

FIBERGLASS REINFORCE PRODUCT SPRAY GUN WITH ROVING CUTTER STEERING MECHANISM

FIELD OF THE INVENTION

This invention relates to glass roving cutters used with spray guns for spraying catalyst and resin components and more particularly relates to a steering mechanism to direct the roving cuttings into the path of the spray.

BACKGROUND OF THE INVENTION

The reinforced plastic industry uses fiberglass cuttings mixed with catalyst and resin components to produce a wide variety of materials and products. For example, glass roving mixed with a resin/catalyst mixture provides a construction which can be used for boat hulls, car bodies, shower stalls and a wide variety of fiberglass reinforced plastic products.

Roving is presently used in the form of continuous filaments collected into a plurality of strands that may contain two hundred to four hundred individual filaments. The roving is fed into an air driven cutter which cuts the strands into predetermined lengths which are discharged into the path of resin/catalyst fluid stream. The roving cutter generally cuts the strand into one inch lengths. Additionally, one to up to six strands of glass roving may be fed to the cutter through roving guide passages in a feed bar. Generally the feed bar will have three adjacent passages.

The roving cutter typically includes a roller having a plurality of cutting blades in engagement with a backup roller referred to as an anvil. The strands of roving pass between the blades of the cutter roller and the anvil and are cut into short lengths which are spewed out of a nozzle into the path of a fluid spray. Because up to six strands may be employed it is difficult to maintain the cut strands of glass centered in the spray. With one strand the glass cuttings may be spewed to the right or left missing part of the streams of resin spray. A typical roving cutter is shown and described in U.S. Pat. No. 3,491,443 issued Jan. 22, 1970.

Further, since the shape of the spray in many of these spray guns may vary according to the size and type of nozzle attached to the spray gun the path of the spray may not always be the same. For example, one such gun for spraying plural components is disclosed and described in U.S. Pat. No. 4,123,007 issued Oct. 31, 1978. The plural component spray system of this patent provides a flat fan shaped spray exiting and adjustable nozzle which is most common.

It is therefore one object of the present invention to provide an adjustable roving cutter which will evenly inject glass cuttings in a plural component spray.

Yet another object of the present invention is to provide a roving cutter adjustment to adjust both vertically and horizontally the direction of cuttings injected into a plural component spray.

Still another object of the present invention is to provide a roving cutter steering mechanism attached to a plural component spray gun having a cam operated adjustment to steer the roving cuttings into the optimum path of the plural component spray.

BRIEF DESCRIPTION OF THE INVENTION

The purpose of the present invention is to provide a steering mechanism for a glass roving cutter mounted on a plural component spray gun which allows the user to align the cutter output with the fluid stream from the gun.

These purposes are achieved by mounting a roving cutter on a mounting plate supported by a bracket which is securely fastened to a boss provided on the upper surface of the spray gun body. A bolt passing through the boss into the bracket allows vertical adjustment of the roving cutter to provide the optimum intersecting angle with the fluid stream provided from the spray gun. The spray gun has a trigger for activating the fluid spray which also activates the roving cutter through an on/off valve. To spray without applying any glass cuttings the valve between the trigger and the roving cutter may be turned off.

The roving cutter mounting bracket also provides a slotted channel receiving a rotary cam which is wrench adjustable. The cam engages the cutter mounting plate and is easily rotated to align the glass cuttings spewed out by the cutter into the optimum path fluid spray pattern. When a single strand of roving is used the cuttings may become displaced to the left or right of the fluid stream. A quick adjustment on the cam will center the roving cuttings in the spray allowing quick alignment of the spray pattern with the cuttings. This prevents batches of glass cuttings from falling off either side of the fluid spray, reducing waste of the expensive fiberglass cuttings. With the device described, substantially all the cut glass fibers are restricted to enter the fluid stream.

Without the steering mechanism aligning the cutter with the spray pattern, glass cuttings may be spit out to the left or right of the spray pattern causing a great deal of waste. The steering device of the present invention allows the user to aim the glass cuttings to maximize the number of glass cuttings entering the fluid stream. Further, if the user changes from a single strand to two, three, or up to six strands, the glass cuttings may be spewed in an entirely different direction creating waste. With the cam operated system steering mechanism of the invention the cutter can be quickly realigned to the center of the spray pattern.

Further, since the roving feed bar has a plurality of glass roving guides the deflection of feed of glass cuttings will differ depending upon which hole strands are put through when fed to the cutter. Depending upon which hole a single strand might be put through the glass cuttings might be deflected right or left of the spray pattern. With the cam operating steering mechanism of the invention the discharge of glass roving cuttings can be quickly and easily aligned with the spray pattern, whether one or six strands are used, or regardless of the particular guide passage used. One strand may be used through either of three guide passages, or six strands may be used.

The above and other novel features and advantages of this invention will be more fully understood from the following detailed description and the accompanying drawings, in which:

DETAILED DESCRIPTION OF THE INVENTION

Figure 1:
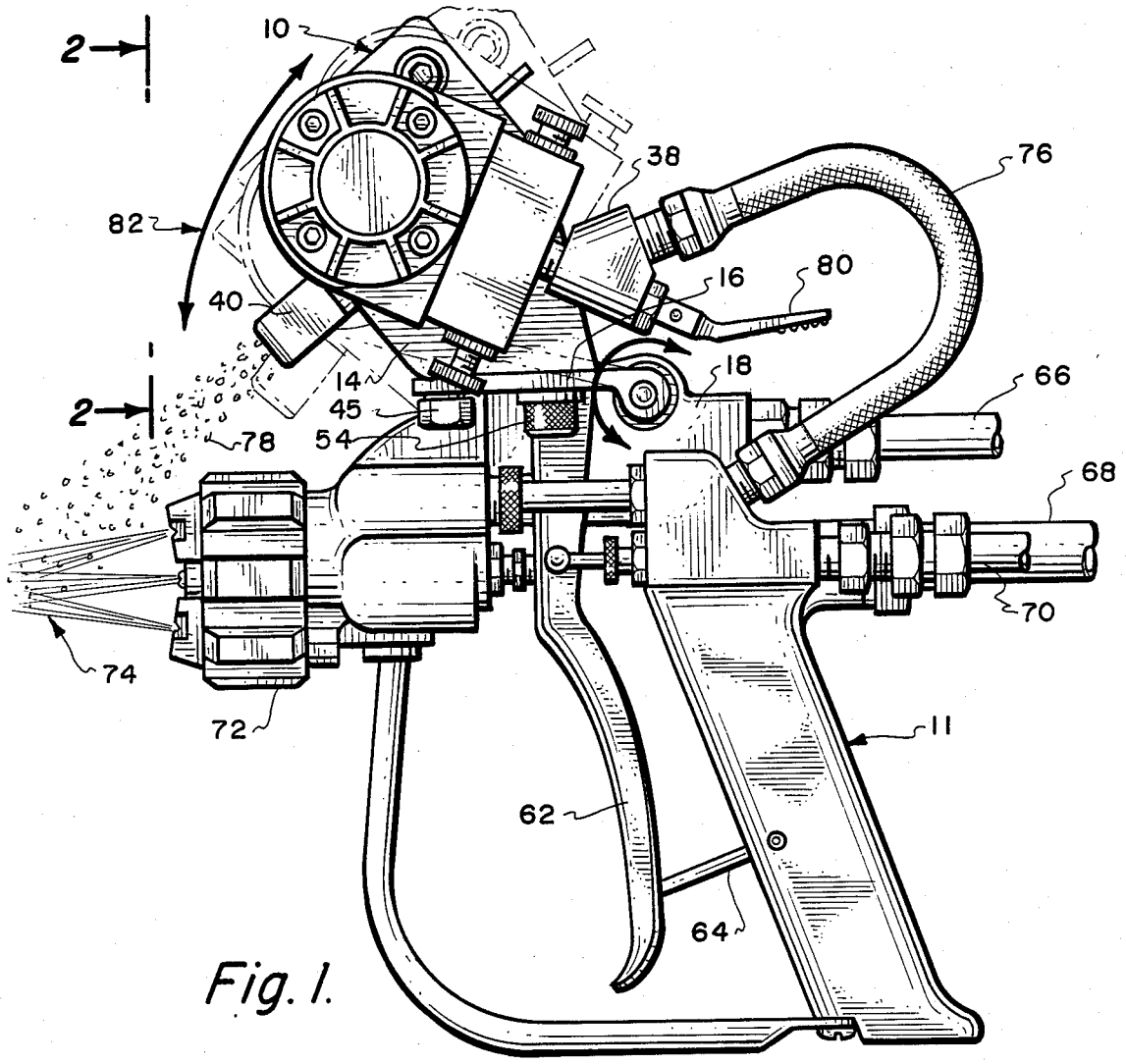
FIG. 1 is a side elevation of a roving cutter mounted on a plural component spray gun according to the invention.
Figure 2:
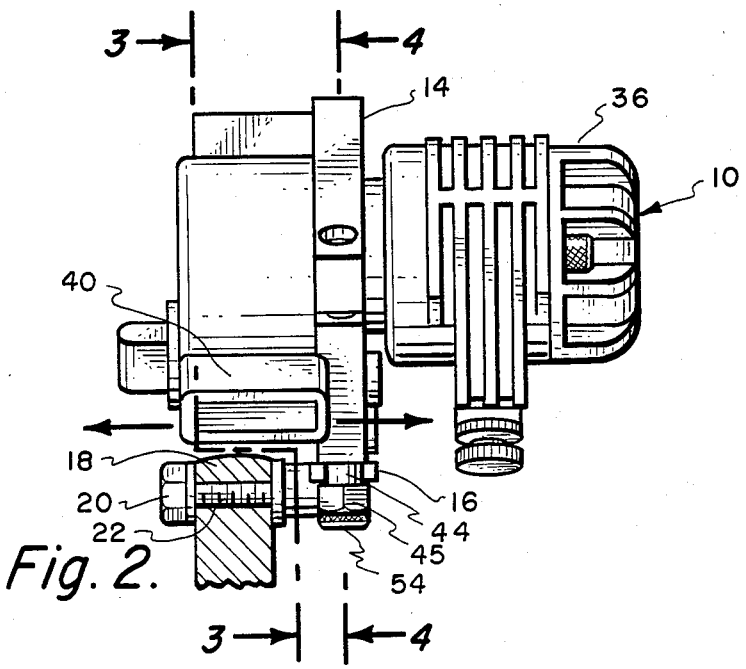
FIG. 2 is a view taken at 2—2 of FIG. 1.

Referring to FIG. 1 roving cutter 10 is mounted on plural component spray gun 11 by means of mounting plate 14 and bracket 16 secured to shoulder or boss 18 on the spray gun 11. Bracket 16 is attached to the spray gun by bolt 20 passing through aperture 22 in boss 18 (FIG. 2). Vertical adjustment of the cutter is provided by simply and rotating bracket 16 and mounting plate 14 as illustrated in phantom in FIG. 1 and will be described in greater detail hereinafter.

Figure 3:
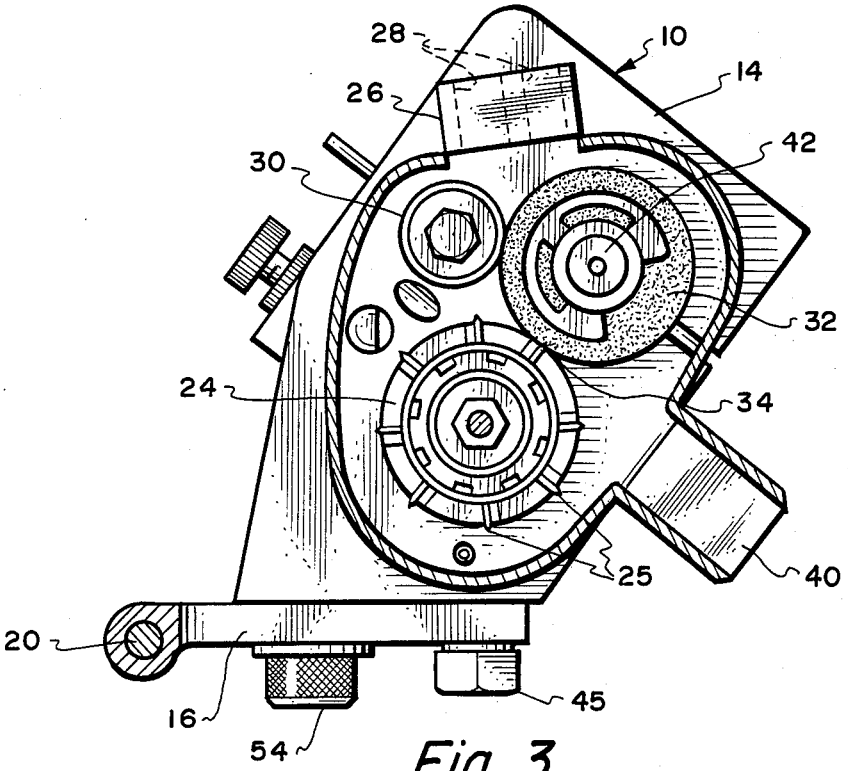
FIG. 3 is a sectional view taken at 3—3 of FIG. 2.
Figure 4:
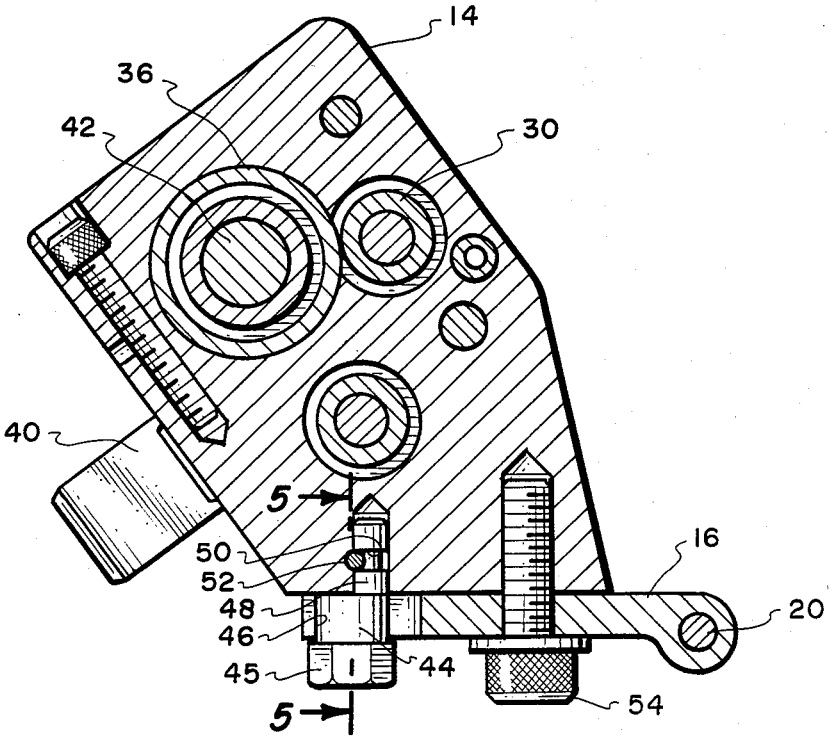
FIG. 4 is a sectional view taken at 4—4 of FIG. 2.
Figure 5:
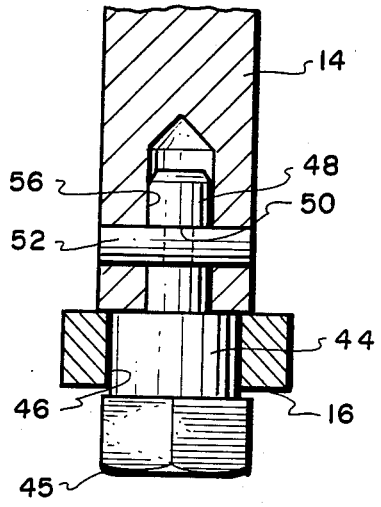
FIG. 5 is a sectional view taken at 5—5 of FIG. 4.

The roving cutter and mounting is shown in greater detail in FIGS. 3 and 4. Roving cutter 10, mounted on support plate 14, has rotating cutter 24 and a plurality of blades 25. The number of blades 26 in the rotating cutter 24 determines the length of the cut roving. A roving cutter with eight blades, a shown, will provide approximately one inch cuts of the glass roving. Longer cuts may be made by reducing the number of blades 26 in the roving rotating cutter 24.

Roving strands are fed to rotating cutter 24 mechanism, through feed bar 26, having guide passages 28, of which there are three. The details of the roving cutter mechanism are described in U.S. Pat. No. 3,491,443 incorporated herein by reference. Up to three guide passages 28 are provided in feed bar 26, usually in an adjacent triangular relationship. Up to six stands of roving are fed through guide passages 28, through the bight formed by pressure or pinch roller 30, and anvil 32, and through bight 34 between anvil 32 and rotating cutter 24.

Air motor 36 drives anvil 32 through drive shaft 42 which in turn drives pinch roller 30 and rotating cutter 24. Air motor 36 is driven by air supplied through valve 38 (FIG. 1). Air valve 38 allows roving cutter to be turned on or off for operation with or without fluid spray from spray gun 11. With valve 38 closed no roving cuttings will be delivered to the fluid stream exiting spray gun 11. Opening valve 38 allows roving cuttings to be injected into the path of the fluid steam exiting the spray gun 11.

The roving fed through guide bar 26 and rotating cutter 24 exits from the cutter through injection nozzle 40 into the path of the fluid stream. Cuttings spewed out of ejection nozzle 40 from roving cutter 10 are steered into the center of the path of the spray pattern by means of cam 44 which adjusts the angle of support plate 14 supporting roving cutter 10. Cam 44 fits into slotted channel 46 in the end of bracket 16, and is secured to the mounting plate 14 by shank 48 having groove 50 receiving mounting pin 52. Mounting plate 14 is secured to the bracket 16 by bolt 54.

The cam and its mounting and operation can be seen more clearly. with reference to FIGS. 5 through 8. The position of cam 44 in channel or slot 46 of bracket 16 is adjusted by means of hex head 45. Shank 48 secures cam 44 to plate 14 by means of pin 52 passing through channel 50 in the shank. As can be seen by reference to FIG. 8, rotation of cam 44 with a wrench on hex head 45 will cause shank 48 to move in a circular motion. Since shank 48 is mounted in aperture 56 in plate 14 the plate will be pivoted to the right or left on its mounting bolt 54.

Figure 6:
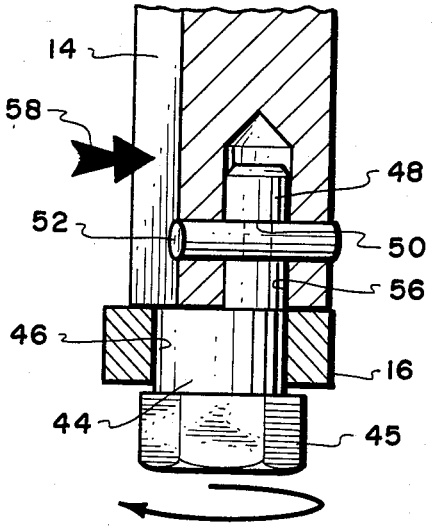
FIGS. 6 and 7 are partial sectional views illustrating the operation of the cam operated steering mechanism according to the invention.
Figure 7:
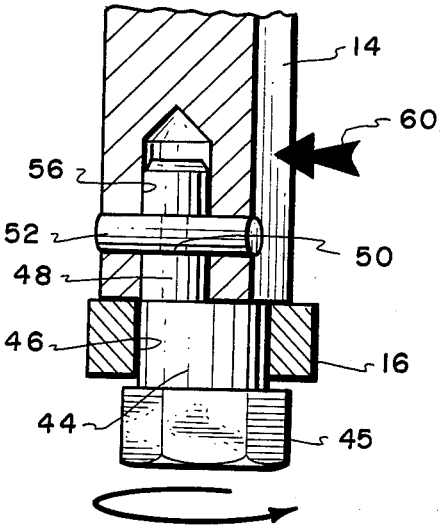
Figure 8:
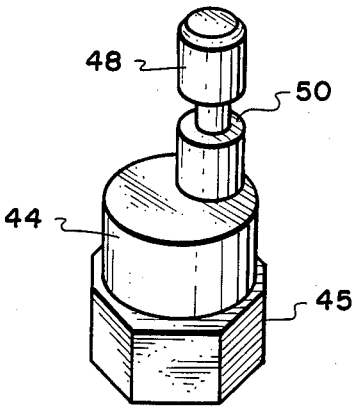
FIG. 8 is a perspective view of the cam for operating the steering mechanism according to the invention.

This operation can be seen with reference to FIGS. 6 and 7. In FIG. 6 clockwise rotation of hex head 45 causes clockwise rotation of cam 44. In the position shown in this figure shank 48 will thus be rotated to pivot or shift mounting plate 14 to the right as indicated by arrow 58. This will shift the output of cuttings from ejection nozzle 40 toward the left edge of the fluid stream exiting the spray gun. Rotation of hex head 45 in the opposite direction (or continued rotation of hex head 45) will cause shank 48 on cam 44 to shift to the left as illustrated in FIG. 7. This will result in mounting plate 14 pivoting or shifting position, as shown by arrow 60, directing the cuttings from injection nozzle 40 toward the right edge of the fluid spray pattern.

The entire system operates as follows. Trigger 62 is released by rotating locking pin 64 out of the way of the trigger. This allows fluid components, such as resin and catalyst delivered through hoses 66, 68 and 70, mixed with air to be delivered to the nozzle 72 for ejection in a spray pattern indicated at 74. The spray pattern is generally a flat fan shaped spray. To deliver glass roving cuttings to the fluid spray pattern air valve 38 is opened allowing air from hose 76 to drive air motor 36 when trigger 62 is operated. Thus the system will simultaneously deliver a spray at 74 simultaneously with glass cuttings indicated at 78 for application to a surface. Valve handle 80 allows valve 38 to be closed so that fluid components can be sprayed from nozzle 72 without any glass cuttings.

Vertical adjustment of the path of the cuttings is made by loosening bolt 20 and vertically adjusting the cutter as indicated at 82 of FIG. 1. Horizontal adjustment of the ejected cuttings is done by rotating cam 44 to shift the position of mounting plate 14 and cutter horizontally depending upon the number and placement of strands of roving being fed to cutter 10 through feed bar 26. Thus, the roving cutter 10 can be adjusted vertically and steered horizontally to assure maximum retention of the cuttings on the surface being formed. In this manner excessive waste is substantially reduced or eliminated.

Thus there has been disclosed a plural component spray gun having a roving cutter which is both vertically and horizontally adjustable to steer or align the glass cuttings with the spray pattern of the fluid. The cutter being mounted on the spray gun by means of a bracket can be adjusted vertically by simply loosening the bracket and retightening it at the position desired, and steered horizontally by rotation of a cam which shifts a mounting plate for the cutter horizontally. The horizontal adjustment allows optimum alignment (i.e. centering) of glass cuttings with the fluid spray pattern exiting the plural component spray gun.

This invention is not to be limited by the embodiment shown in the drawings and described in the description which is given by way of example and not of limitation, but only in accordance with the scope of the appended claims.

We claim:

1. Apparatus for controlling the flow of fiberglass roving cuttings into the path of a fluid stream from a spray gun comprising;

a fiberglass roving cutter;

a support plate for supporting said fiberglass roving cutter;

a bracket attached to said support plate;

said bracket having a mounting hole in one end and a slot in the other;

bolt means passing through the hole in said end of said bracket mounting said bracket and support plate on said spray gun with an ejection nozzle of said roving cutter directed toward a fluid stream exiting said spray gun; said bolt means allowing said ejection nozzle to be vertically adjusted by rotation of said bracket and support plate on said bolt;

means for horizontally adjusting said ejection nozzle;

said means for horizontally adjusting said support plate comprises rotatable cam means constructed and arranged to pivot said support plate from side to side when rotated;

whereby the intersecting of fiberglass roving cuttings and a fluid stream path may be optimized.

2. Apparatus according to claim 1 in which said cam means comprises; a cam; a shank on said cam engaging an aperture in said support plate; said cam being rotatably positioned in said slot in said other end of said bracket whereby rotation of said cam causes rotation of said shank to pivot said support plate from side to side whereby the path of glass cuttings may be adjusted to optimize their intersection with a fluid stream from said spray gun.

3. Apparatus according to claim 2 in which said cam means includes a hex head on said cam whereby said support plate and roving cutter may be easily and quickly adjusted by rotation of said cam with a wrench.

* * * * *